US010472597B2

(12) United States Patent
Letzelter et al.

(10) Patent No.: US 10,472,597 B2
(45) Date of Patent: Nov. 12, 2019

(54) MULTI-PHASE UNIT-DOSE CLEANING PRODUCT

(71) Applicant: The Procter & Gamble Company, Cincinnati, OH (US)

(72) Inventors: Nathalie Sophie Letzelter, Trimdon (GB); Elena Alda, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 92 days.

(21) Appl. No.: 15/219,570

(22) Filed: Jul. 26, 2016

(65) Prior Publication Data

US 2017/0029750 A1 Feb. 2, 2017

(30) Foreign Application Priority Data

Jul. 29, 2015 (EP) ..... 15178893

(51) Int. Cl.

| | |
|---|---|
| ***C11D 1/75*** | (2006.01) |
| ***C11D 3/30*** | (2006.01) |
| ***C11D 3/39*** | (2006.01) |
| ***C11D 3/395*** | (2006.01) |
| ***C11D 17/04*** | (2006.01) |
| ***C11D 3/33*** | (2006.01) |

(52) U.S. Cl.

CPC ..... *C11D 17/043* (2013.01); *C11D 1/75* (2013.01); *C11D 3/30* (2013.01); *C11D 3/33* (2013.01); *C11D 3/3902* (2013.01); *C11D 3/3942* (2013.01); *C11D 3/3945* (2013.01); *C11D 17/045* (2013.01)

(58) Field of Classification Search

CPC .... C11D 1/75; C11D 3/30; C11D 3/33; C11D 3/3902; C11D 3/3942; C11D 3/3945; C11D 17/045

USPC ..... 510/220, 221, 296, 439, 480, 499, 503

See application file for complete search history.

(56) References Cited

U.S. PATENT DOCUMENTS

| | | | | |
|---|---|---|---|---|
| 5,308,532 | A | 5/1994 | Adler et al. | |
| 5,856,164 | A | 1/1999 | Outtrup et al. | |
| 6,093,562 | A | 7/2000 | Bisgard-Frantzen et al. | |
| 2,311,542 | A | 12/2000 | Williams | |
| 6,943,143 | B2 | 9/2005 | Kinloch | |
| 6,979,667 | B1 | 12/2005 | Kaiser | |
| 7,214,722 | B2 | 5/2007 | Kinloch | |
| 2005/0003982 | A1* | 1/2005 | Beckholt | B65D 85/808 510/293 |
| 2005/0061704 | A1 | 3/2005 | Cole et al. | |
| 2005/0202995 | A1 | 9/2005 | Waits et al. | |
| 2007/0241022 | A1* | 10/2007 | Denome | B65B 9/042 206/524.7 |
| 2008/0081774 | A1* | 4/2008 | Koch | C11D 3/50 510/101 |
| 2010/0101612 | A1 | 4/2010 | Wiedemann | |
| 2010/0139695 | A1 | 6/2010 | Wiedemann | |
| 2012/0097193 | A1 | 4/2012 | Rossetto | |
| 2013/0199569 | A1 | 8/2013 | Cabirol et al. | |
| 2014/0008016 | A1* | 1/2014 | Koch | C11D 3/50 156/291 |
| 2014/0179585 | A1 | 1/2014 | Souter et al. | |
| 2014/0057821 | A1 | 2/2014 | Heppert | |
| 2014/0179586 | A1 | 6/2014 | Letzelter et al. | |
| 2014/0323383 | A1* | 10/2014 | Trujillo | C11D 17/0039 510/439 |
| 2015/0166943 | A1 | 6/2015 | Campbell et al. | |
| 2015/0252292 | A1 | 9/2015 | Solache Leon | |
| 2015/0376556 | A1* | 12/2015 | Ohtani | C11D 17/043 510/386 |
| 2016/0145543 | A1* | 5/2016 | Letzelter | C11D 17/043 510/406 |
| 2016/0145544 | A1* | 5/2016 | Letzelter | C11D 3/2079 510/406 |
| 2016/0145545 | A1* | 5/2016 | Letzelter | C11D 17/043 510/406 |
| 2016/0145546 | A1* | 5/2016 | Letzelter | C11D 3/3773 510/406 |
| 2017/0029751 | A1 | 2/2017 | Letzelter et al. | |

FOREIGN PATENT DOCUMENTS

| | | | |
|---|---|---|---|
| EP | 1 022 334 | A2 | 7/2000 |
| EP | 1 375 637 | A1 | 1/2004 |
| EP | 1 504 994 | A2 | 2/2005 |
| JP | 2008037885 | A | 2/2008 |
| JP | 2010168534 | A | 8/2010 |
| WO | WO 94/22800 | A1 | 10/1994 |
| WO | WO 96/23873 | A1 | 8/1996 |
| WO | WO 97/00324 | A1 | 1/1997 |
| WO | WO 99/23211 | A1 | 5/1999 |
| WO | WO 00/37627 | A1 | 6/2000 |
| WO | WO 00/60060 | A2 | 10/2000 |
| WO | WO 02/20361 | A1 | 3/2002 |
| WO | WO 02/092456 | A1 | 11/2002 |
| WO | WO 2006/002643 | A2 | 1/2006 |
| WO | WO 2008/010925 | A2 | 1/2008 |
| WO | WO 2009/092699 | A1 | 7/2009 |

(Continued)

OTHER PUBLICATIONS

Extended European Search Report; Application No. 15178893.2-1358; dated Nov. 2, 2015; 8 pages.

(Continued)

*Primary Examiner* — Gregory R Delcotto

(74) *Attorney, Agent, or Firm* — John T. Dipre

(57) ABSTRACT

A multi-phase unit-dose cleaning product comprising: i) an amine-containing cleaning active selected from the group consisting of aminocarboxylic complexing agent, amine oxide surfactant and mixtures thereof; and ii) an oxidizing agent wherein at least 30% of the amine-containing cleaning active is in a different phase from the oxidizing agent.

4 Claims, No Drawings

(56) References Cited

FOREIGN PATENT DOCUMENTS

| | | | |
|---|---|---|---|
| WO | WO 2011/130076 | A1 | 10/2011 |
| WO | WO 2013/092276 | A1 | 6/2013 |
| WO | WO2015118010 | A1 | 8/2015 |

OTHER PUBLICATIONS

Extended European Search Report; Application No. 15178895.7-1375; dated Jan. 25, 2016; 6 pages.

* cited by examiner

MULTI-PHASE UNIT-DOSE CLEANING PRODUCT

TECHNICAL FIELD

The present invention is in the field of cleaning unit-dose products. In particular it relates to a unit-dose cleaning product, the product comprises an amine-containing cleaning active. The product presents very good cleaning and improved olfactory profile.

BACKGROUND OF THE INVENTION

Some cleaning actives might have malodours associated to them. Malodours can be made worse by the interaction of some cleaning actives with other components of the cleaning product. Cleaning products are marketed in a packing container. Malodours accumulate in the confined headspace of the container and are easily perceived when opening the package. This is the first moment of interaction between the consumer and the product. The acceptance of the product is to a great extent based on this moment. Consumers can find malodours unpleasant and may associate them with harsh chemicals. This can adversely impact on consumer acceptance.

Malodours could be masked with strong or high levels of perfume however, the use of strong perfumes in cleaning products may not be well accepted by consumers, especially in the case of automatic dishwashing compositions. Consumers do not like to use highly perfumed products on items which are going to be in contact with food.

The objective of the present invention is to find a cleaning product that provides good cleaning and has a good olfactory profile.

SUMMARY OF THE INVENTION

According to a first aspect of the invention there is provided a multi-phase unit-dose cleaning product. The product comprises an amine-containing cleaning active acid and an oxidizing agent. At least 30%, more preferably at least 50% of the amine-containing cleaning active and the oxidizing agent are in different phases of the unit-dose product. The product provides good cleaning and has a good olfactory profile and it does not give rise to malodour even when it is packed in a packing container.

By "unit-dose cleaning product" is herein meant a cleaning product that contains an amount sufficient to provide enough detergent for one wash. Suitable unit dose forms include tablets, pouches, etc. Preferred for use herein are pouches, in which the cleaning composition is wrapped in water-soluble material preferably made of polyvinyl alcohol, preferably having a thickness of less than 100 μm. These films are permeable to amine based malodours. Detergent packs comprising these detergent products can present acute malodour problems. By "multi-phase product" is herein meant a product that has more than a phase, the phases can share interface, as in the case or multi-layer tablets or can be physically separated, as in the case of multi-compartment pouches.

Preferably, the cleaning product of the invention is an automatic dishwashing cleaning product and it preferably weighs from about 8 to about 25 grams, more preferably from about 10 to about 20 grams. This weight range fits comfortably in a dishwasher dispenser.

When the cleaning product, or part thereof, is in particulate form, the enveloping material preferably has a pin hole to allow the escape of any gases that might form during the storage of the cleaning product. This facilitates the escape of amine based malodours further contributing to the malodour of the detergent pack.

It has been found that a better olfactory profile is provided when at least part of the amine-containing cleaning active is in liquid form.

Preferably the level of an amine-containing cleaning active is from 10% to 50% by weight of the product. Products having high level of amine-containing cleaning active can have part of the amine-containing cleaning active in particulate form and part in liquid form.

Amine-containing cleaning actives can generate malodours that may be caused by impurities, degradation or interaction with other components of the composition, such as bleach. The product of the invention greatly reduces or overcomes the malodour issues.

It has been found that when an amine-containing cleaning active is part of unit-dose cleaning products it can give rise to malodour. The malodour can be even more evident when the unit-dose cleaning products are packed in a packing container. The container can be impermeable to malodours or permeable to small malodour molecules. In some case the rate of malodour generation is faster than the rate of permeation of the malodour to the surrounding environment, in this conditions the malodour can be concentrated in the headspace and it is released every time that the user opens the bag, this malodour is not very pleasant and may connote lack of cleaning. When the unit-dose cleaning products of the invention are packed in a packing container, the malodour problem is reduced or even not existing, even when the concentration of the amine-containing cleaning active is high (for example, from about 10% to about 50% by weight of the product).

The interaction of the amine-containing cleaning active and the oxidizing agent can increase the malodour of the product. Particularly bad olfactory profiles can be generated by products comprising amine-containing cleaning active, in particular aminocarboxylic complexing agents, more in particular salts of methyl glycine diacetic acid, and bleach.

The product of the invention produces unit-dose products with good olfactory profile even when the product comprises an amine-containing cleaning active, in particular aminocarboxylic complexing agents, more in particular salts of methyl glycine diacetic acid, and a bleach. The unit-dose product of the invention comprises an amine-containing cleaning active, in particular a salt of methyl glycine diacetic acid, and bleach and presents a pleasant olfactory profile.

According to a second aspect of the invention, there is provided a detergent pack comprising a packing container comprising a plurality of the unit-dose products of the invention. The smell obtained when the container is open is better than the smell from containers containing unit-dose products outside the scope of the invention.

According to a third aspect of the invention, there is provided a method of ameliorating malodour generated in a detergent pack comprising a packing container comprising a plurality of unit dose products comprising an amine-containing cleaning active, in particular aminocarboxylic complexing agents, more in particular salts of methyl glycine diacetic acid, and an oxidizing agent, in particular bleach, the method comprising the step of making a multi-phase unit-dose cleaning product and placing the amine-containing cleaning active and the oxidizing agent in different phases of the unit-dose product.

All the features of the first aspect of the invention apply mutatis mutandis to the second and third aspect of the invention.

Preferably, the composition of the invention is alkaline, by "alkaline" is herein meant that the pH of the composition is greater than 7, preferably greater than 9 as measured in 1% weight aqueous solution in distilled water at 20° C. Alkaline composition can be more prone to chemical instability caused by moisture. Preferably the composition of the invention comprises bleach, more preferably sodium pecarbonate. Bleach can contribute to malodour generation by interacting with the amine-containing cleaning active.

DETAILED DESCRIPTION OF THE INVENTION

The present invention envisages a unit-dose cleaning product comprising an amine-containing cleaning active, preferably an aminocarboxylic complexing agent, more in particular a salt of methyl glycine diacetic acid and an oxidizing agent, preferably bleach, more preferably percabonate. The product provides good cleaning and presents good olfactory profile.

Unit-dose Cleaning Product

The cleaning product of the invention is presented in unit-dose form. Products in unit dose form include tablet, capsules, sachets, pouches, injection moulded containers, etc. Preferred unit-dose products are pouches, where the cleaning composition is enveloped by a water-soluble film, preferably having a thickness of less than 100 μm and injection moulded containers wherein the cleaning composition is placed in a container of water-soluble material made by injection moulding. Both the cleaning composition and the enveloping material are water-soluble. They readily dissolve when exposed to water in an automatic dishwashing process, preferably during the main wash. The cleaning product has a plurality of phases, preferably the cleaning product has a plurality of compartments, more preferably each compartment comprises a different phase. The compartments can comprise a composition in liquid or solid form. Preferably, in the cleaning product of the invention at least part of the amine-containing cleaning active is in liquid form and it is preferably accommodated in a compartment made of a water-soluble film, preferably having a thickness of less than 100 μm.

Preferably, the unit-dose cleaning product can by in the form of a multi-compartment pouch or multi-compartment injection moulded container. By "multi-compartment" is herein meant a pouch or injection moulded container having at least two compartments, preferably at least three compartments, each compartment contains a composition surrounded by enveloping material, preferably polyvinyl alcohol. The compartments can be in any geometrical disposition. The different compartments can be adjacent to one another, preferably in contact with one another. Especially preferred configurations for use herein include superposed compartments (i.e. one above the other), side-by-side compartments, etc. Especially preferred from a view point of automatic dishwasher dispenser fit, stability and enveloping material reduction are multi-compartment pouches or containers having some superposed compartments and/or some side-by-side compartments.

The unit-dose products are preferably multi-compartment water-soluble pouches. The pouches can be made using any known process in the art. For example, the pouches can be made using a water-soluble film as described in EP 1 504 994 A2. Alternatively, the pouches can be made using injection moulding as described in WO 02/092456 or by using a thermoforming process as described in EP 1 375 637 A1.

Enveloping Material

The enveloping material is water soluble. By "water-soluble" is herein meant that the material has a water-solubility of at least 50%, preferably at least 75% or even at least 95%, as measured by the method set out herein after using a glass-filter with a maximum pore size of 20 microns. 50 grams+−0.1 gram of enveloping material is added in a pre-weighed 400 ml beaker and 245 ml+−1 ml of distilled water is added. This is stirred vigorously on a magnetic stirrer set at 600 rpm, for 30 minutes at 20° C. Then, the mixture is filtered through a folded qualitative sintered-glass filter with a pore size as defined above (max, 20 micron). The water is dried off from the collected filtrate by any conventional method, and the weight of the remaining material is determined (which is the dissolved or dispersed faction). Then, the % solubility can be calculated.

The enveloping material is any water-soluble material capable of enclosing the cleaning composition of the product of the invention. The enveloping material can be a polymer that has been injection moulded to provide a casing or it can be a film. Preferably the enveloping material is made of polyvinyl alcohol. Preferably the enveloping material is a water-soluble polyvinyl alcohol film.

The pouch can, for example, be obtained by injection moulding or by creating compartments using a film. The enveloping material is usually moisture permeable. The pouch of the invention is stable even when the enveloping material is moisture permeable.

Preferred substances for making the enveloping material include polymers, copolymers or derivatives thereof selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Especially preferred for use herein is polyvinyl alcohol and even more preferred polyvinyl alcohol films.

Most preferred enveloping materials are PVA films known under the trade reference Monosol M8630, as sold by Kuraray, and PVA films of corresponding solubility and deformability characteristics. Other films suitable for use herein include films known under the trade reference PT film or the K-series of films supplied by Aicello, or VF-HP film supplied by Kuraray.

The enveloping material herein may comprise other additive ingredients than the polymer or polymer material and water. For example, it may be beneficial to add plasticisers, for example glycerol, ethylene glycol, diethyleneglycol, propylene glycol, dipropylene glycol, sorbitol and mixtures thereof. Preferably the enveloping material comprises glycerol as plasticisers. Other useful additives include disintegrating aids.

Cleaning Product

The product of the invention is presented in unit-dose form and it can be in any physical form including solid, liquid and gel form. The product of the invention is very well suited to be presented in the form of a multi-compartment pouch, more in particular a multi-compartment pouch comprising compartments containing compositions in different physical forms, for example a compartment comprising a composition in solid form and another compartment comprising a composition in liquid form. The composition is preferably enveloped by a water-soluble film such as polyvinyl alcohol. The composition comprises an amine-containing cleaning active and an oxidizing agent. Preferably, the oxidizing agent is a bleach, more preferably sodium percarbonate. Preferably the composition also comprises a dispersant polymer, more preferably a sulfonated polymer comprising 2-acrylamido-2-methylpropane sulfonic acid monomers, and preferably an inorganic builder, more preferably carbonate, a bleach activator, a bleach catalyst, protease and amylase enzymes, non-ionic surfactant, a crystal growth inhibitor, more preferably HEDP.

The product of the invention preferably has a pH as measured in 1% weight aqueous solution in distilled water at 20° C. of from about 9 to about 12, more preferably from about 10 to less than about 11.5 and especially from about 10.5 to about 11.5.

The product of the invention preferably has a reserve alkalinity of from about 10 to about 20, more preferably from about 12 to about 18 at a pH of 9.5 as measured in NaOH with 100 grams of product at 20° C.

Aminocarboxylic Complexing Agent

A complexing agent is a material capable of sequestering hardness ions, particularly calcium and/or magnesium.

The complexing agent is preferably selected from the group consisting of methyl-glycine-diacetic acid (MGDA) and its salts, glutamic-N,N-diacetic acid (GLDA) and its salts and mixtures thereof. Especially preferred complexing agent for use herein is a salt of MGDA, in particular the three sodium salt of MGDA.

The product of the invention preferably comprises from 5% to 50%, more preferably from 10 to 45% by weight of the composition of an aminocarboxylic complexing agent, preferably a salt of methyl-glycine-diacetic acid, a salt of glutamic-N,N-diacetic acid or a mixture thereof. Especially preferred salt of methyl glycine diacetic acid and glutamic-N,N-diacetic acid are the tri-sodium salts.

When methyl glycine diacetic acid is in particulate form, the particle preferably comprises:

a) from 20 to 95%, more preferable from 40 to 60% by weight of the particle of aminocarboxylic acid, preferably a salt of methyl glycine diacetic acid, more preferably the tri-sodium salt;

b) from 5 to 80% by weight of the particle of material selected from the group consisting of:

i) polyalkylene glycol, preferably polyethylene glycol ii) nonionic surfactant;

iii) a polymer selected from the group consisting of polyvinyl alcohols, polyvinylpyrrolidones (PVP), and iv) a mixture thereof.

Preferred polyethylene glycols in component (b) have an average molecular weight (weight-average molecular weight) of from 500 to 30,000 g/mol, more preferably of from 1000 to 5000 g/mol, most preferably from 1200 to 2000 g/mol.

Nonionic surfactants in component (b) are preferably selected from the group consisting of alkoxylated primary alcohols, alkoxylated fatty alcohols, alkylglycosides, alkoxylated fatty acid alkyl esters, amine oxides and polyhydroxy fatty acid amides. Preferably the nonionic surfactant in component (b) has a melting point of above 20° C.

The particle may be produced by dissolving components (a) and (b) in a solvent and spray-drying the resulting mixture, which may be followed by a granulation step. In this process, components (a) and (b) may be dissolved separately, in which case the solutions are subsequently mixed, or a powder mixture of the components may be dissolved in water. Useful solvents are all of those which can dissolve components (a) and (b); preference is given to using, for example, alcohols and/or water, particular preference to using water. Spray-drying is preferably followed by a granulation step.

Preferably the particle has a weight geometric mean particle size of from about 700 to about 1000 μm with less than about 3% by weight above about 1180 μm and less than about 5% by weight below about 200 μm.

Preferably the particle has a bulk density of at least 550 g/l, more preferably from about 600 to about 1,400 g/l, even more preferably from about 700 g/l to about 1,200 g/l. This makes the particle suitable for use in detergent compositions, especially automatic dishwashing detergent compositions.

Amine Oxide Surfactant

Amine oxides surfactants are useful for use in the product of the invention. Preferred amine oxides for use herein are alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3) O wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides. Preferred amine oxides include linear C10, linear C10-C12, and linear C12-C14 alkyl dimethyl amine oxides.

Amine oxide surfactants may be present in amounts from 0 to 15% by weight, preferably from 0.1% to 10%, and most preferably from 0.25% to 5% by weight of the product.

Oxidizing Agent

An oxidizing agent is an element or compound in an oxidation-reduction reaction that accepts electrons from other species. The preferred oxidizing agent for use herein is bleach, especially sodium percarbonate.

Bleach

The product of the invention preferably comprises from about 1 to about 20%, more preferably from about 2 to about 15%, even more preferably from about 3 to about 12% and especially from about 4 to about 10% by weight of the product.

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially diperoxydodecanedioc acid, diperoxytetradecanedioc acid, and diperoxyhexadecanedioc acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). If present the composition of the invention comprises from 0.01 to 1, preferably from 0.2 to 0.5% by weight of the product of bleach activator, preferably TAED.

Bleach Catalyst

The composition herein preferably contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include manganese triazacyclononane and related complexes; Co, Cu, Mn and Fe bispyridylamine and related complexes; and pentamine acetate cobalt(III) and related complexes.

Preferably the composition of the invention comprises from 0.001 to 0.5, more preferably from 0.002 to 0.05% of bleach catalyst by weight of the product. Preferably the bleach catalyst is a manganese bleach catalyst.

Inorganic Builder

The composition of the method of the invention preferably comprises an inorganic builder. Suitable inorganic builders are selected from the group consisting of carbonate, silicate and mixtures thereof. Especially preferred for use herein is sodium carbonate. Preferably the composition of the invention comprises from 5 to 50%, more preferably from 10 to 40% and especially from 15 to 30% of sodium carbonate by weight of the product.

Dispersant Polymer

The polymer, if present, is used in any suitable amount from about 0.1% to about 30%, preferably from 0.5% to about 20%, more preferably from 1% to 10% by weight of the product. Preferably the dispersant polymer is a sulfonated polymer, more preferably a sulfonated polymer comprising 2-acrylamido-2-methylpropane sulfonic acid monomers and carboxyl monomers.

Polycarboxylate Polymer

For example, a wide variety of modified or unmodified polyacrylates, polyacrylate/maleates, or polyacrylate/methacrylates are highly useful. It is believed these polymers are excellent dispersing agents and enhance overall detergent performance, particularly when used in the composition of the invention.

Suitable polycarboxylate-based polymers include polycarboxylate polymers that may have average molecular weights of from about 500 Da to about 500,000 Da, or from about 1,000 Da to about 100,000 Da, or even from about 3,000 Da to about 80,000 Da. Suitable polycarboxylates may be selected from the group comprising polymers comprising acrylic acid such as Sokalan PA30, PA20, PA15, PA10 and sokalan CP10 (BASF GmbH, Ludwigshafen, Germany), Acusol™ 45N, 480N, 460N and 820 (sold by Rohm and Haas, Philadelphia, Pa., USA) polyacrylic acids, such as Acusol™ 445 and Acusol™ 420 (sold by Rohm and Haas, Philadelphia, Pa., USA) acrylic/maleic co-polymers, such as Acusol™ 425N and acrylic/methacrylic copolymers.

Alkoxylated polycarboxylates such as those prepared from polyacrylates are useful herein to and can provide additional grease suspension. Chemically, these materials comprise polyacrylates having one ethoxy side-chain per every 7-8 acrylate units. The side-chains are ester-linked to the polyacrylate "backbone" to provide a "comb" polymer type structure. The molecular weight can vary, but may be in the range of about 2000 to about 50,000.

Unsaturated monomeric acids that can be polymerized to form suitable dispersing polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Co-polymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Sulfonated Polymers

Suitable sulfonated polymers described herein may have a weight average molecular weight of less than or equal to about 100,000 Da, preferably less than or equal to about 75,000 Da, more preferably less than or equal to about 50,000 Da, more preferably from about 3,000 Da to about 50,000, and specially from about 5,000 Da to about 45,000 Da.

The sulfonated polymers preferably comprises carboxylic acid monomers and sulfonated monomers. Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamido-methyl propane sulfonic acid. Preferred non-ionic monomers include one or more of the following: methyl (meth) acrylate, ethyl (meth) acrylate, t-butyl (meth) acrylate, methyl (meth) acrylamide, ethyl (meth) acrylamide, t-butyl (meth) acrylamide, styrene, or α-methyl styrene.

Specially preferred sulfonated polymers for use herein are those comprising monomers of acrylic acid and monomers of 2-acrylamido-methyl propane sulfonic acid.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas, Versaflex Si™ (sold by Alco Chemical, Tennessee, USA) and those described in U.S. Pat. No. 5,308,532 and in WO 2005/090541.

Suitable styrene co-polymers may be selected from the group comprising, styrene co-polymers with acrylic acid and optionally sulphonate groups, having average molecular weights in the range 1,000-50,000, or even 2,000-10,000 such as those supplied by Alco Chemical Tennessee, USA, under the tradenames Alcosperse® 729 and 747.

Other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates. Preferred cellulose-derived dispersant polymers are the carboxymethyl celluloses.

Yet another group of acceptable dispersing agents are the organic dispersing polymers, such as polyaspartates.

Amphilic graft co-polymer are useful for use herein. Suitable amphilic graft co-polymer comprises (i) polyethylene glycol backbone; and (ii) and at least one pendant moiety selected from polyvinyl acetate, polyvinyl alcohol and mixtures thereof. In other examples, the amphilic graft copolymer is Sokalan HP22, supplied from BASF.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated nonionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R10[CH2CH(CH3)O]x[CH2CH2O]y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH) R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Enzymes

In describing enzyme variants herein, the following nomenclature is used for ease of reference: Original amino acid(s):position(s):substituted amino acid(s). Standard enzyme IUPAC 1-letter codes for amino acids are used.

Proteases

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus,* such as *Bacillus lentus, B. alkalophilus, B. subtilis, B. amyloliquefaciens, Bacillus pumilus* and *Bacillus gibsonii.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus,* comprising mutations in one or more, preferably two or more and more preferably three or more of the following positions, using the BPN' numbering system and amino acid abbreviations as illustrated in WO00/37627, which is incorporated herein by reference:V68A, N87S, S99D, S99SD, S99A, S101G, S101M, S103A, V104N/I, G118V, G118R, S128L, P129Q, S130A, Y167A, R170S, A194P, V205I and/or M222S.

Most preferably the protease is selected from the group comprising the below mutations (BPN' numbering system) versus either the PB92 wild-type (SEQ ID NO:2 in WO 08/010925) or the subtilisin 309 wild-type (sequence as per PB92 backbone, except comprising a natural variation of N87S).

(i) G118V+S128L+P129Q+S130A (ii) S101M+G118V+S128L+P129Q+S130A (iii) N76D+N87R+G118R+S128L+P129Q+S130A+S188D+N248R (iv) N76D+N87R+G118R+S128L+P129Q+S130A+S188D+V244R (v) N76D+N87R+G118R+S128L+P129Q+S130A (vi) V68A+N87S+S101G+V104N Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4C), Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the product of the invention include from about 0.1 to about 10, more preferably from about 0.5 to about 7 and especially from about 1 to about 6 mg of active protease.

Amylases

Preferred enzyme for use herein includes alpha-amylases, including those of bacterial or fungal origin. Chemically or genetically modified mutants (variants) are included. A preferred alkaline alpha-amylase is derived from a strain of *Bacillus,* such as *Bacillus licheniformis, Bacillus amyloliquefaciens, Bacillus stearothermophilus, Bacillus subtilis,* or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 enzyme listed as SEQ ID No. 12 in WO 06/002643:

9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.

(b) variants exhibiting at least 95% identity with the wild-type enzyme from *Bacillus* sp.707 (SEQ ID NO:7 in U.S. Pat. No. 6,093,562), especially those comprising one or more of the following mutations M202, M208, S255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, POWERASE®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, POWERASE® and mixtures thereof.

Preferably, the product of the invention comprises at least 0.01 mg, preferably from about 0.05 to about 10, more preferably from about 0.1 to about 6, especially from about 0.2 to about 5 mg of active amylase.

Additional Enzymes

Additional enzymes suitable for use in the product of the invention can comprise one or more enzymes selected from the group comprising hemicellulases, cellulases, cellobiose dehydrogenases, peroxidases, proteases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, and mixtures thereof.

Preferably, the protease and/or amylase of the product of the invention are in the form of granulates, the granulates comprise less than 29% of sodium sulfate by weight of the granulate or the sodium sulfate and the active enzyme (protease and/or amylase) are in a weight ratio of less than 4:1.

Crystal Growth Inhibitor

Crystal growth inhibitors are materials that can bind to calcium carbonate crystals and prevent further growth of species such as aragonite and calcite.

Especially preferred crystal growth inhibitor for use herein is HEDP (1-hydroxyethylidene 1,1-diphosphonic acid). Preferably, the composition of the invention comprises from 0.01 to 5%, more preferably from 0.05 to 3% and especially from 0.5 to 2% of a crystal growth inhibitor by weight of the product, preferably HEDP.

Metal Care Agents

Metal care agents may prevent or reduce the tarnishing, corrosion or oxidation of metals, including aluminium, stainless steel and non-ferrous metals, such as silver and copper.

Preferably the composition of the invention comprises from 0.1 to 5%, more preferably from 0.2 to 4% and especially from 0.3 to 3% by weight of the product of a metal care agent, preferably the metal care agent is benzo triazole (BTA).

Glass Care Agents

Glass care agents protect the appearance of glass items during the dishwashing process. Preferably the composition of the invention comprises from 0.1 to 5%, more preferably from 0.2 to 4% and specially from 0.3 to 3% by weight of the product of a metal care agent, preferably the glass care agent is a zinc containing material, specially hydrozincite.

Detergent Pack

The detergent pack can be a tub, tray, jar, bottle, bag, box, etc, preferably the pack is reclosable.

Preferably the packaging container has a moisture vapour transfer rate of less than 0.25 g/m2/day at 38° C. and 90% relative humidity. Suitable packaging containers for use herein include those described in WO 02/20361. A specially preferred packaging container is a self-standing flexible bag as described in WO 03/047998 page 4, lines 6 to 26 and FIG. 1, preferably with a non-return valve. Preferably the pack is a reclosable flexible bag and preferably self-standing.

By "flexible" bag is understood a bag which can be easily deformed with a hand squeeze, preferably deformed by the mere act of holding the bag.

EXAMPLES

To illustrate the advantages of the invention, two dishwashing detergent compositions were prepared. The compositions were placed in a multi-compartment water-soluble pouch having a compartment containing a powder composition and three compartments superposed onto the powder-containing compartment. The three compartments contain liquid compositions.

Composition A (comparative) has all the amine-containing cleaning active (MGDA) in the same phase as the oxidizing agent (percarbonate). In Composition B (according to the invention) part of the amine-containing cleaning active (MGDA) is in the same phase as the oxidizing agent (percarbonate) and part (MGDA and GLDA) is in a different phase from the phase in which the oxidizing agent is.

Less malodour is generated with the product of the invention.

| Grams of active material | Composition A Comparative | Composition B Invention |
|---|---|---|
| Powder | | |
| Granular MGDA | 5.00 | 2.20 |
| Sodium 1-hydroxyethane-1,1-diphosphonate | 0.10 | 0.10 |
| Sodium carbonate | 4.00 | 4.00 |
| Amylase | 0.004 | 0.004 |
| Protease | 0.034 | 0.034 |
| Sodium percarbonate | 2.00 | 2.00 |
| Sulphonated polyacrylates | 1.20 | 1.20 |
| Non-ionic surfactant 1 | 0.10 | 0.10 |
| Benzotriazol | 0.08 | 0.08 |
| Bleach catalyst | 0.004 | 0.004 |
| Perfume | 0.087 | 0.087 |
| Miscellaneous | Balance to 14.84 | Balance to 10.05 |
| Liquid 1 | | |
| Non-ionic surfactant 1 | 0.25 | 0.75 |
| Non-ionic surfactant 2 | 0.30 | 0.90 |

-continued

| Grams of active material | Composition A Comparative | Composition B Invention |
|---|---|---|
| Di-propylene glycol | 0.10 | 0.30 |
| Miscellaneous | Balance to 0.73 | Balance to 2.19 |
| Liquid 2 | | |
| Non-ionic surfactant 1 | 0.25 | — |
| Non-ionic surfactant 2 | 0.30 | — |
| Di-propylene glycol | 0.10 | — |
| MGDA | — | 0.70 |
| GLDA | — | 0.70 |
| Potassium formate | — | 0.24 |
| Miscellaneous/water | Balance to 0.72 | Balance to 2.94 |
| Liquid 3 | | |
| Non-ionic surfactant 1 | 0.25 | — |
| Non-ionic surfactant 2 | 0.30 | — |
| Di-propylene glycol | 0.10 | — |
| MGDA | — | 0.70 |
| GLDA | — | 0.70 |
| Na formate | — | 0.24 |
| Miscellaneous/water | Balance to 0.72 | Balance to 2.94 |

Granular MGDA: Trilon M, provided by BASF

MGDA: liquid methyl glycine diacetic acid, trisodium salt

GLDA: liquid L-Glutamic acid N,N-diacetic acid, tetrasodium salt, provided by BASF Sulphonated polymer: Acusol 588® supplied by Rhom and Haas Non-ionic surfactant 1: Plurafac SLF180® supplied by BASF Non-ionic surfactant 2: Lutensol TO7 supplied by BASF Bleach catalyst: Manganese based bleach catalyst.

Two pouches of each composition were prepared; the pouches were made of polyvinyl alcohol (Monosol 8630, supplied by Kuraray). The pouches were individually stored in four small glass jars with a tightly closed plastic lid. Two glass jars were placed in a climatic chamber at 50° C. and removed after 18 hours, the remaining two glass jars were placed in a climatic chamber at 40° C. for 5 weeks. After the glass jars were removed from the climatic chambers, they were allowed to cool to room temperature and then they were opened for olfactory evaluation of the headspace in the jar. A malodour grade scale from 1 to 10 was used, where 1 is low malodour intensity and 10 means very strong malodour intensity.

| After 18 hours at 50° C. | |
|---|---|
| | Malodour grade |
| Composition A | 7 |
| Composition B | 3 |

| After 5 weeks at 40° C. | |
|---|---|
| | Malodour grade |
| Composition A | 2 |
| Composition B | 1 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multi-phase unit-dose cleaning product comprising:

i) from about 10% to about 50%, by weight of the product, of an amine-containing cleaning active selected from the group consisting of aminocarboxylic complexing agent, amine oxide surfactant and mixtures thereof;

ii) from about 4% to about 10%, by weight of the product, of sodium percarbonate; and iii) from about 0.2% to 0.5%, by weight of the product, of tetraacetylethylenediamine;

wherein at least about 30% of the amine-containing cleaning active is in a different phase from the sodium percarbonate, wherein the product is in the form of a multi-compartment water-soluble pouch comprising an enveloping material comprising a water-soluble film, wherein a first compartment comprises a solid composition comprising an aminocarboxylic complexing agent in particulate form wherein the enveloping material of the first compartment has a pin hole to allow the escape of any gases that might for during the storage of the cleaning product, wherein a second compartment comprises a composition in liquid form comprising the aminocarboxylic complexing agent in liquid form, wherein the aminocarboxylic complexing agent is a salt of methyl glycine diacetic acid, wherein the composition has a pH greater than 9 and at least about 50% of the amine-containing cleaning active is in the second compartment.

2. The cleaning product according to claim 1 wherein the cleaning product is an automatic dishwashing product.

3. A detergent pack comprising a packing container comprising a plurality of unit dose products according to claim 1.

4. A method of ameliorating malodour generated in a detergent pack comprising a packing container the method comprising adding a plurality of multi-phase unit dose cleaning products according to claim 1 to said container.

* * * * *